US005743716A

United States Patent [19]

Smith

[11] Patent Number: 5,743,716

[45] Date of Patent: Apr. 28, 1998

[54] REVERSIBLE PUMP CONTROLLER

[75] Inventor: Norris Edward Smith, Lufkin, Tex.

[73] Assignee: Air-Go Windmill, Inc., Lufkin, Tex.

[21] Appl. No.: 652,364

[22] Filed: May 23, 1996

[51] Int. Cl.[6] ..... F04B 49/00

[52] U.S. Cl. ..... 417/46; 417/904; 417/53; 60/371

[58] Field of Search ..... 417/46, 53, 375, 417/904, 398, 399, 401, 403, 390; 60/369, 371, 372; 91/48, 50, 304, 337, 338

[56] References Cited

U.S. PATENT DOCUMENTS

| | | | |
|---|---|---|---|
| 1,031,362 | 7/1912 | Mohr . | |
| 1,588,784 | 6/1926 | Trout . | |
| 2,299,692 | 10/1942 | Goehring . | |
| 2,555,426 | 6/1951 | Troutman . | |
| 3,029,650 | 4/1962 | Byrd . | |
| 3,939,656 | 2/1976 | Goldfein . | |
| 4,299,545 | 11/1981 | Bever . | |
| 4,449,896 | 5/1984 | Klepper et al. | 417/399 |
| 4,474,002 | 10/1984 | Perry . | |
| 4,503,752 | 3/1985 | Olson et al. | 60/369 |
| 4,512,149 | 4/1985 | Weaver | 60/371 |
| 4,534,168 | 8/1985 | Brantly | 60/369 |
| 4,646,518 | 3/1987 | Hochsattel | 60/413 |
| 4,707,993 | 11/1987 | Kime | 60/372 |
| 4,724,672 | 2/1988 | Olmsted | 60/371 |
| 4,762,473 | 8/1988 | Tieben . | |
| 5,481,873 | 1/1996 | Saruwatari et al. | 60/421 |

FOREIGN PATENT DOCUMENTS

| | | | |
|---|---|---|---|
| 4941C03 | 4/1977 | U.S.S.R. | 417/904 |

OTHER PUBLICATIONS

U.S. Patent Application Serial No. 08/572,197, entitled Regenerative Hydraulic Power Transmission for Down Hole Pump, filed Dec. 13, 1995.

*Primary Examiner*—Jack B. Harvey
*Assistant Examiner*—Xuan M. Thai

[57] ABSTRACT

A reversible flow variable rate hydraulic swashplate pump furnishes hydraulic fluid to stroke a piston supporting a subsurface pump. The controller determines reversal of pump flow and timing and speed of upstroke and downstroke of the subsurface pump. No valving restricts hydraulic fluid flow, and energy from the falling mass of the beam and sucker rods is accumulated during downstroke to be utilized during upstroke. The invention also includes the method steps of pumping hydraulic fluid to a cylinder containing a piston supporting the subsurface pump piston at a constant increasing rate until a maximum preset flow is reached, decreasing the flow to zero at a rate different than the increasing rate, reversing the hydraulic fluid flow to flow from the cylinder to the hydraulic pump at a constant increasing rate until maximum preset reverse flow is reached, and reducing reversed flow to zero at a rate different than the increasing flow rate.

12 Claims, 4 Drawing Sheets

20
22
21
26
25
50
53
23
23a
54
63
42
40
61
59
18
24
16
58
62
30
19
51
29
38
37
13
38
31
27
35
15
10a
14
17
32a
11
12
34
36
32
10

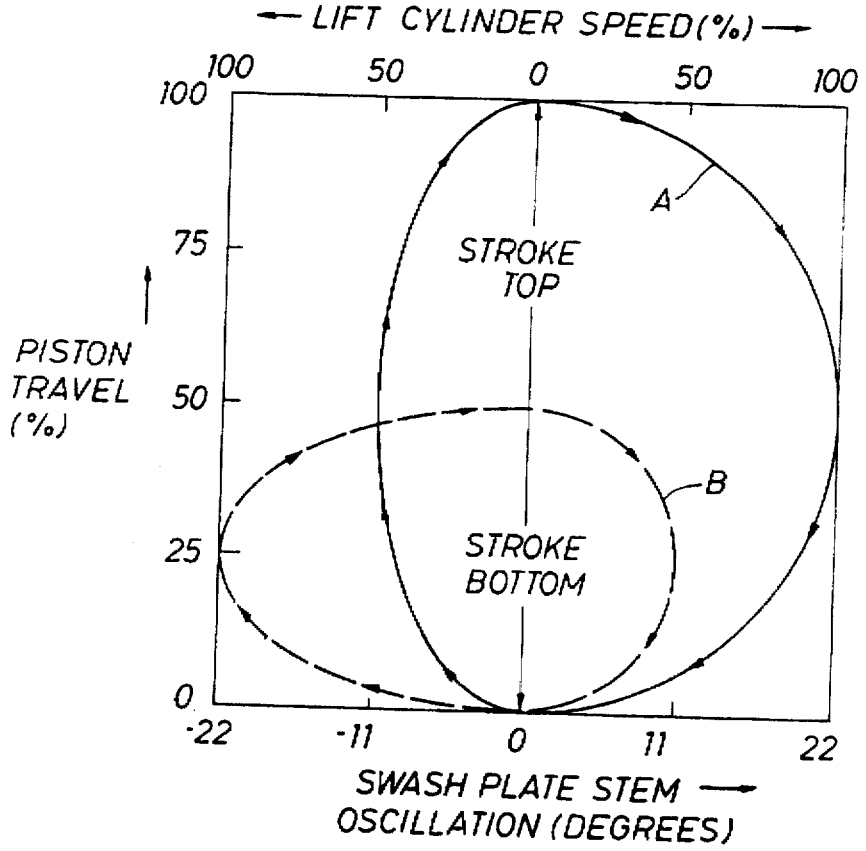
FIG. 6
FIG. 7
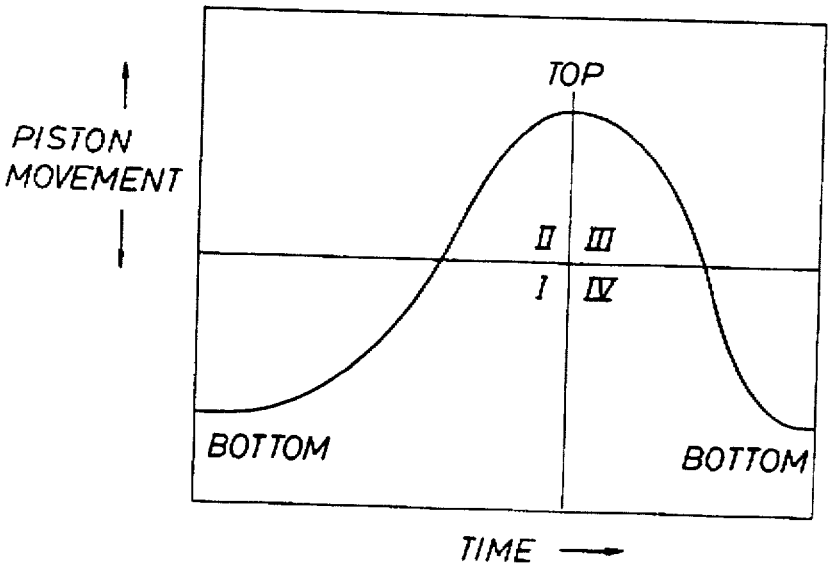

REVERSIBLE PUMP CONTROLLER

FIELD OF THE INVENTION

This invention relates to controllers for hydraulic pumping units which power subsurface pumps.

BACKGROUND OF THE INVENTION

Pumping units for deep wells, including water and oil wells, have been, for the most part, pumping units, both mechanical and hydraulic, having a counterweighted beam, or "horsehead." Rods, called sucker rods, supported by the surface pumping unit, extend from the surface to the subsurface pump, and can weigh thousands of pounds. The counterweights balance the weight of the rods and lifted fluid and attempt to smooth out the load on the prime mover for the pumping unit. The weight of such units necessitates equally massive support structure and resulting bearing or friction losses of efficiency. Certain units have counterweights associated with the axle of the gearing so that the counterweight falls during upstroke of the subsurface pump. Some hydraulic units have been constructed using heavy counterweights and others utilize pneumatic accumulators which are pressured by downstroke and energy is released and utilized during upstroke.

Although swashplate hydraulic pumps have been utilized in such applications, the control mechanisms have not been adequate to give sufficient variability of control within a single upstroke or downstroke of the subsurface pump. Such inability contributes to a lack of pumping efficiency, particularly for long stroke pumps, and can lead to premature sucker rod failure by exerting tension forces of too great a magnitude in the phase of the upstroke or downstroke when maximum tension is exerted on the rods.

SUMMARY OF THE INVENTION

The invention is a hydraulic pump controller and method for operating a hydraulic pump which minimizes sucker rod stress and provides smooth transition between upstroke and downstroke. The controller includes means for sensing the position or stage of the pumping unit piston in the pumping cycle, means mechanically linked to the sensing means for transmitting the position of the piston to a variable flow reversible hydraulic pump, means to reverse and increase flow to the hydraulic pump from zero to full flow, and means to override the reversing and increasing means for decreasing flow from the hydraulic pump from full flow to zero at a rate different from the rate of increase in flow from the pump.

The method of the invention includes pumping hydraulic fluid to a cylinder operating a subsurface pump at a constant increasing rate until a preset maximum flow rate is reached, decreasing hydraulic fluid flow to the cylinder at a rate different than the rate at which flow was increased until flow to the cylinder ceases, reversing the flow of fluid to the cylinder and increasing the reversed flow at a constant rate until maximum reverse flow rate is reached, and reducing the reversed flow rate to zero at a rate different than the increasing rate. Certain aspects of the method gather the energy of the falling mass attached to the pumping unit piston on downstroke to partially power the upstroke of the unit.

BRIEF DESCRIPTION OF THE DRAWINGS

Reference is now made to the drawings, in which:

FIG. 6 is a graph showing two examples of full stroke cycles of the hydraulic pump showing cylinder travel of the pumping unit piston in terms of percent of full travel versus hydraulic pump swashplate oscillation in degrees.

FIG. 7 is a graph showing pumping unit piston travel in a complete cycle versus time.

DESCRIPTION OF THE PREFERRED EMBODIMENT

Figure 1:
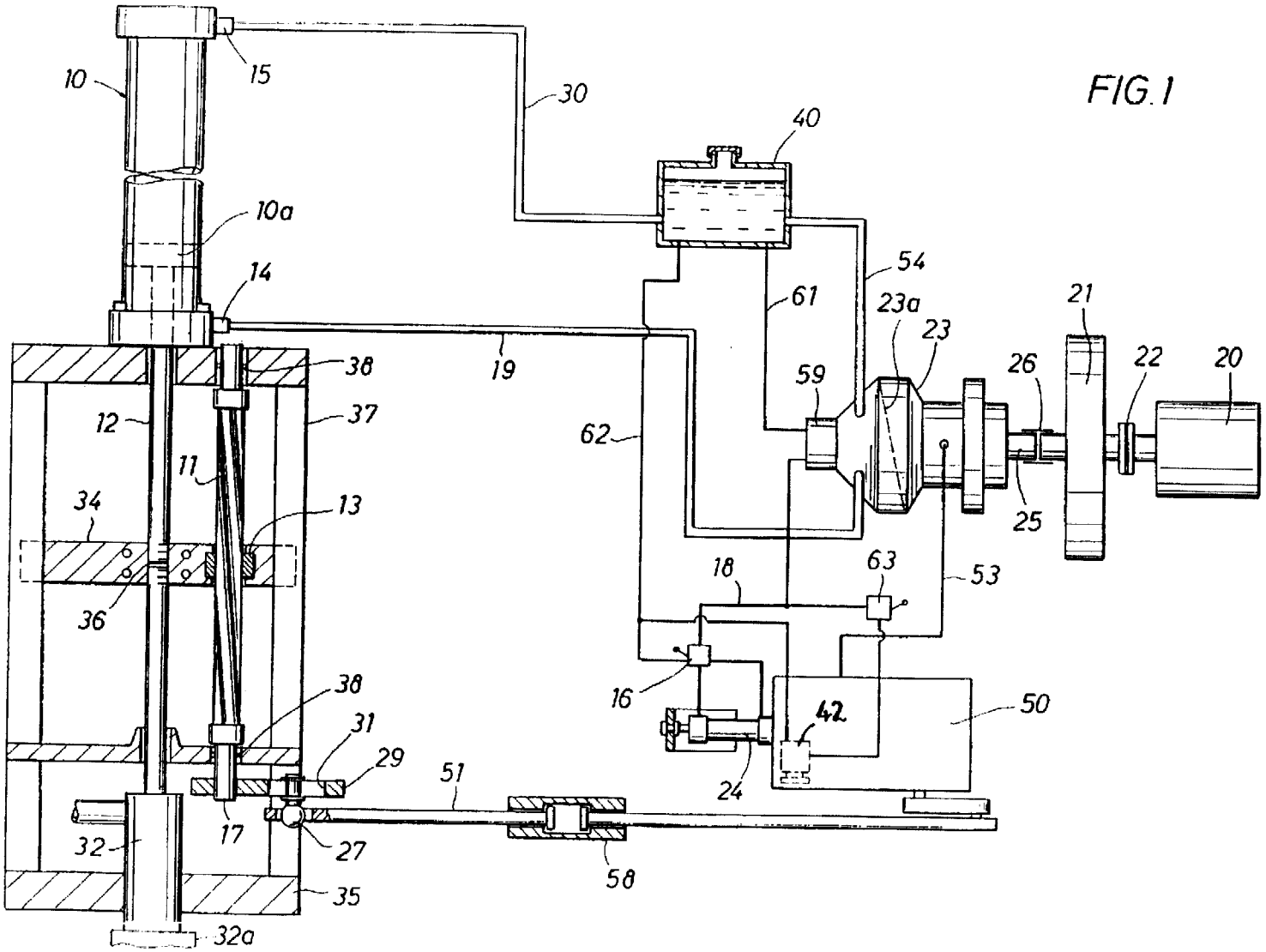
FIG. 1 is a schematic representation of a hydraulic pumping unit, the hydraulic pump powering same and the linkage between the pumping unit piston sensor and the hydraulic pump controller.

A preferred embodiment of the hydraulic pumping unit is shown in FIG. 1. An oil or water well surface installation is shown having a well head (32), in which a polished rod (33) reciprocates. Polished rod (33) supports a string of sucker rods (not shown) which are attached to the piston of a subsurface well bore pump (not shown). Such downhole sucker rod pumps are well known and used extensively in subsurface pumping applications. The piston of such subsurface pumps is operated by vertically reciprocating the sucker rod string suspended from polished rod (33) by up and down movement of the piston rod (12) of the lift cylinder generally designated by the numeral (10). The derrick (37) rests on a platform (35). Derrick (37) supports lift cylinder (10) in which the pumping unit piston (not shown) is contained. Pumping unit piston (not shown) is connected to a piston rod (12) joined at its other end by a piston rod clamp (36) to polished rod (33).

As hydraulic fluid is admitted to the fluid inlet (14) of the hydraulic lift cylinder (10), the hydraulic piston is urged upwardly and piston (10*a*) rod (12) attached thereto causes polished rod (33) to stroke the sucker rods suspended therefrom and the piston (10*a*) of the subsurface pump upwardly.

Lift cylinder (10) also includes a hydraulic drain (15) connected by a hydraulic fluid drain line (30) to tank (40). Since lift cylinder (10) is a single-acting cylinder, hydraulic drain (15) merely serves to convey to the fluid tank (40) the hydraulic fluid which has seeped past the hydraulic piston into the unpressured upper portion of lift cylinder (10). Piston (10*a*) rod (12) may be surrounded with an appropriate dust-tight enclosure (not shown).

Fluid inlet (14) of lift cylinder (10) is fluidly connected to the hydraulic, or hydrostatic, pump (23) which obtains hydraulic fluid from tank (40) through the supply line (54) and supplies the fluid to lift cylinder (10) during the subsurface pump upstroke. During downstroke of the subsurface pump, hydraulic fluid flows from lift cylinder (10) out fluid inlet (14) through the hydraulic power line (19), through hydrostatic pump (23) and into fluid reservoir (40) via the supply line (54). The reversal of flow through hydrostatic pump (23) permits the capture of energy of the falling mass of sucker rods (not shown) on the subsurface pump and hydraulic piston downstroke.

In FIG. 1, a mechanical arrangement for sensing the position of the pumping unit piston and piston rod (12) is shown. Following the motion and position of the pumping unit piston and piston (10*a*) rod (12) is a spiral timing shaft (11), joined to the lift cylinder traveling bar (34). Spiral timing shaft (11) is mounted for rotation about its long axis in derrick structure (37) by the upper and lower shaft bearings (38). The lower end of spiral timing shaft (11) is joined at a right angle to a slotted timing lever (29). Timing lever (29) has a timing lever slot (31) at a predetermined, adjustable, distance from a timing lever pivot (17) which is fixed for pivoting movement of timing lever (29) thereabout to a portion of platform (35). Thus the position and movement of polished rod (33), piston rod (12) and timing rod (11) are transmitted by a controller rod (51) to controller (50). Timing lever bearing (27) may be fixed at different positions in timing lever slot (31) to cause greater or lesser movement of controller rod (51) to provide means for sensing the position of the pumping unit piston and piston (10*a*) rod (12).

Spiral timing shaft (11) is rotated, for example, 180 degrees, by a guide (13) as lift cylinder traveling bar (34) is raised and lowered with piston rod (12). Timing lever (29) is fixed to a lower portion of spiral timing shaft (11) and is oscillated in the example 180 degrees by spiral timing shaft's (11) action through guide (13) which induces rotary motion of spiral timing shaft (11) as lift cylinder traveling bar (34) moves with respect to derrick frame (37). Timing lever (29) reciprocates timing rod (51). Timing rod (51) turns or rotates the controller crank (56) of the controller (50) (FIG. 2) during the latter phases of upstroke and downstroke, as will be later explained. The further from the center of rotation of spiral timing shaft (11) that timing lever bearing (27) is fixed, the greater the longitudinal movement of timing rod (51).

The power for hydraulic, or hydrostatic pump (23) is provided on the upstroke of the unit by the power train. The power train includes a power source (20) and a hydrostatic pump (23), a variable displacement, axial multipiston, reversible swashplate pump such as that available from Oilgear Company, Hydura model PVW or from Mannesmann Rexroth, model A(A)4VSGHW. Such pumps permit reversible flow variable fluid volume cycles and variable flow rates during such cycles depending upon the angle of the swashplate of the pump. Such pumps eject pressured fluid by action of the pistons powered by a power shaft (25) when flow is in a first direction, and when reversed, can extract energy from the reversed pressurized fluid by operating the pistons which transfer energy to power shaft (25). Such pumps are well known and available for use in various positive displacement and high pressure applications.

The prime mover, or power source (20), may be a conventional internal combustion engine, electric motor or other power source, such as a windmill. If a windmill is used, the inertial assist, or flywheel (21) may be incorporated into the rotating wind turbine, or be a separate mechanical element inserted into the power train. A flywheel (21) is connected to power source (20) by a flywheel clutch (22) which permits kinetic energy to be gradually added into flywheel (21) at startup of the pumping operation by engagement or disengagement with power source (20). The power from power source (20) and flywheel (21) is transmitted to hydrostatic pump (23) by power shaft (25) through the power connector (26). Power shaft (25) rotates the fluid cylinders and pistons of hydraulic pump (23) against its swashplate (23*a*) which produces the flow of pressured hydraulic fluid to lift cylinder (10) during subsurface pump upstroke. The swashplate (not shown) of hydrostatic pump (23) controls the rate, direction and volume of fluid through hydrostatic pump (23).

No restrictor values are present in lift cylinder (10), hydraulic power line (19) or hydrostatic pump (23). The flow of hydraulic fluid to or from lift cylinder (10) is controlled by controller (50), and is dependent in part upon the position of the piston 23*a* in lift cylinder (10). That position is relayed to a swashplate setting mechanism, such as a pintle control shaft (53) (FIG. 2) to set the swashplate by moving the swashplate shaft (not shown) to the proper angle for desired direction and rate of flow.

Figure 2:
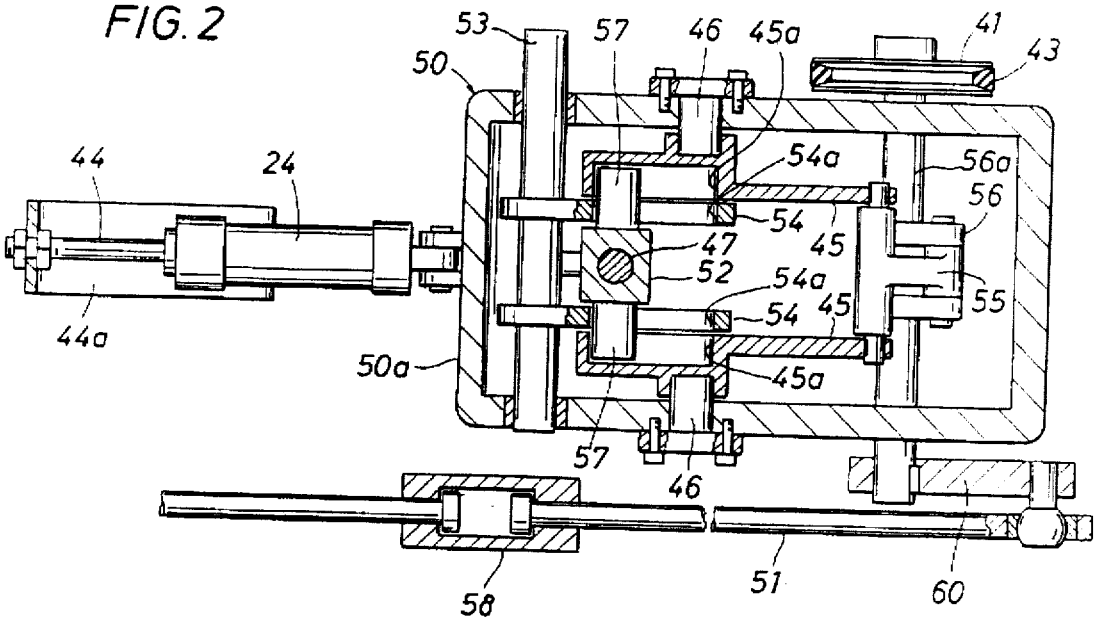
FIG. 2 is a partially schematic view of the linkage between the pumping unit piston sensor and the controller, showing a partial side elevation cross-sectional view of the controller with parts in position to provide maximum swashplate movement.
Figure 3:
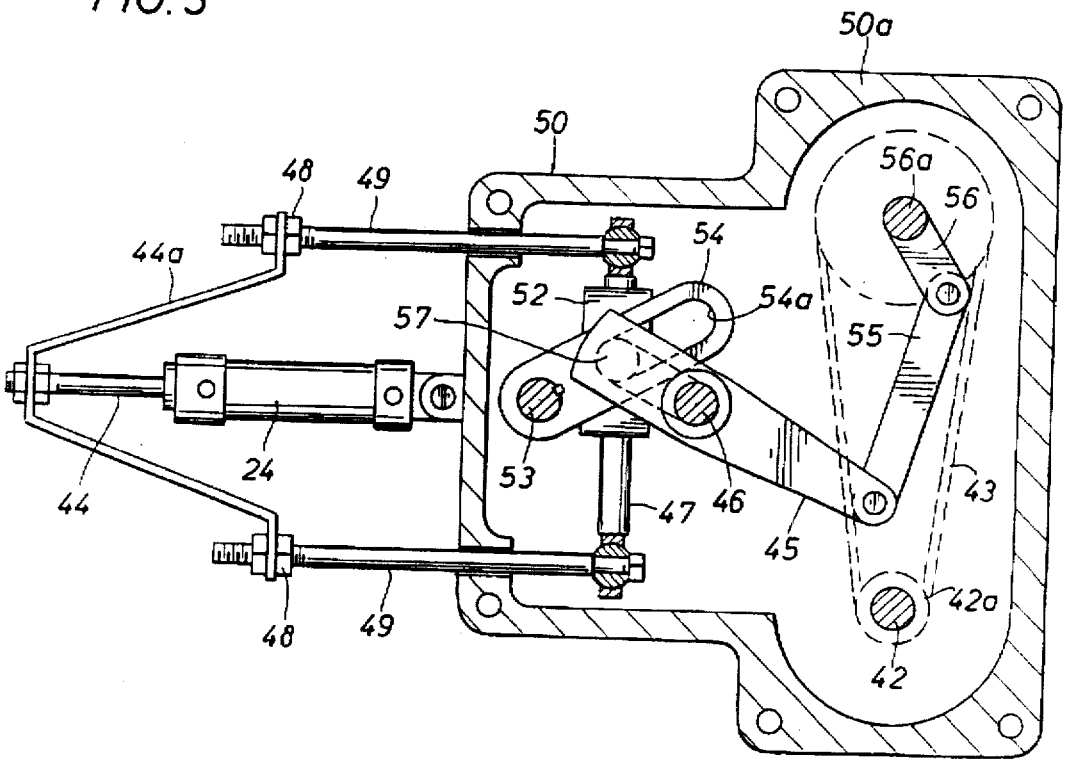
FIG. 3 is a top plan view in partial cross-section of the controller in the same operational position as shown in FIG. 2.

Referring now to FIGS. 2 and 3, controller (50) mechanically receives the position of timing rod (51), which indicates the latter stages of upstroke and downstroke of polished rod (33) and determines the position of the pintle control shaft (53) during such stages of stroke. In FIGS. 2 and 3, piston rod (12) in lift cylinder (10) is at mid-stroke and pintle control shaft (53) has moved to its maximum deviation from neutral. During controlling of transition, or reversal, of fluid flow in pump (23) and the early stage of upstroke and downstroke, a rotary drive source such as the adjustable speed orbital hydraulic motor (42) controls the movement of pintle control shaft (53) and therefore the position of the swashplate (23*a*) in hydraulic pump (23).

Pintle control shaft (53) is oscillated by the driven lever (54), fixed at a right angle thereto in the body (50*a*) of controller (50). Pintle control shaft (53) is mounted for reciprocating rotary motion through a limited range of swashplate (not shown) angle change about its long axis in body (50) by suitable bearings (23*a*). The motion of driven lever (54) is determined by the position of the drive lever (45) as it is oscillated about the drive lever pivot (46) fixed with respect to body (50*a*), together with the setting of the cross guide (52), a block which moves axially along the cross guide rod (47) during oscillation of pintle control shaft (53). Cross guide (52) includes an upper and lower pair of crossguide cam rollers (57) which engage the elongated openings (54*a*) in driven lever (54) and the cooperating elongated openings (45*a*) of drive lever (45).

The position of cross guide rod (47) is determined by movement toward or away from body (50*a*) of the controller rods (49). Each of controller rods (49) may be adjusted independently with respect to body (50*a*) by the adjusting nuts (48) which are affixed to threads in controller rods (49). FIG. 3 shows cross guide rod (47) in a position perpendicular to controller rods (49) which results from equal adjustment lengths for controller rods (49) with respect to body (50*a*) and the control piston rod (44). This position causes driven lever (54) to oscillate, and thereby pintle control shaft (53) to rotate the swashplate (23*a*) of hydraulic pump (23) equally in both positive and negative fluid flow directions. Such equal movement from perpendicular, or neutral, position of pintle control shaft (53) causes equal forward and reverse flow in hydraulic pump (23). Unequal adjustment of adjusting nuts (48) with respect to control piston rod (44) would produce unequal motion of driven lever (54) and pintle shaft (53) and thereby produce unequal hydraulic fluid flow to lift cylinder (10) during downstroke and upstroke in polished rod (33) (FIG. 1). The proximity of cross guide rod (47) to drive lever pivot (46) determines the degree of movement during upstroke and downstroke of driven lever (54).

Figure 4:
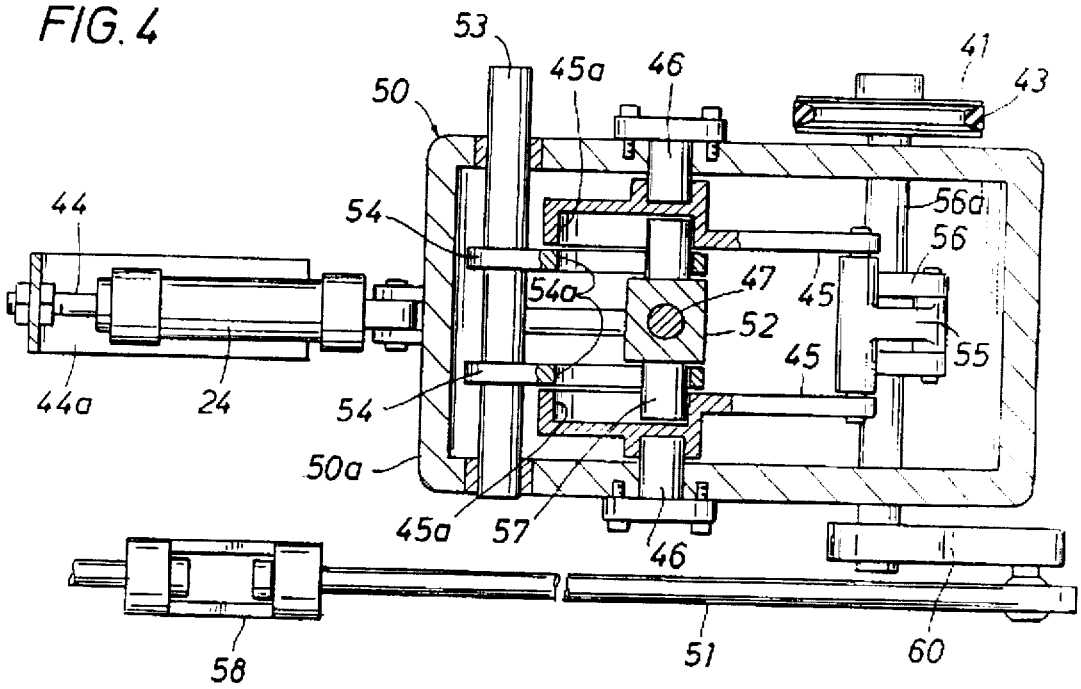
FIG. 4 is the controller in partial cross-section with parts in position to put the pump swashplate in neutral position.
Figure 5:
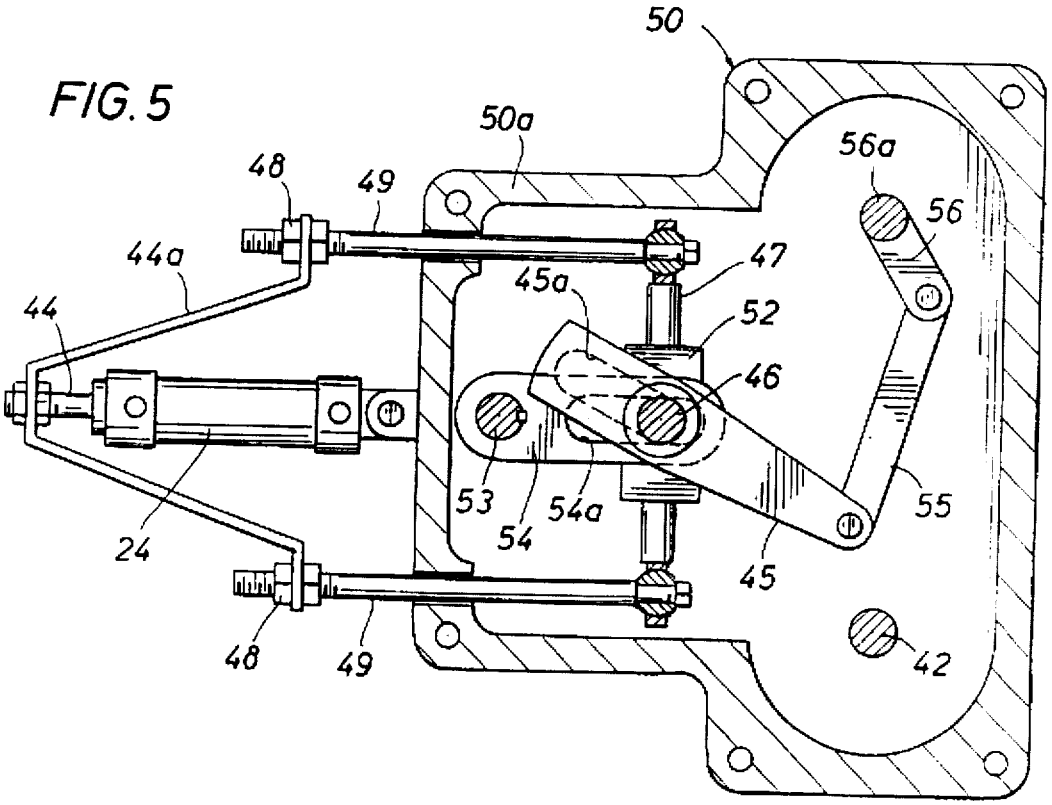
FIG. 5 is a top plan view of the controller in partial section with parts in the neutral position as shown in FIG. 4.

Referring to FIGS. 4 and 5, as both controller rods (49) are moved into the body (50*a*) of controller (50) by the controller cylinder (24) acting on the control connector (44a), the center of cam rollers (57) approach coincidence with the center of rotation of drive lever pivot (46). Controller cylinder (24) is a two-way cylinder with a piston (not shown) contained therein to drive control piston rod (44) in and out with respect to body (50a). When the center of cam rollers (57) and drive lever pivot (46) are aligned, no movement of driven lever (54) and pintle control shaft (53) will occur despite reciprocation of drive lever (45). That position is neutral, or producing no flow to or from lift cylinder (10) from hydraulic pump (23).

As controller rods (49) are withdrawn from body (50a) by action of controller cylinder (24) (FIGS. 2 and 3), oscillation of drive lever (45) causes greater and greater movement in driven lever (54), which movement reaches a maximum as cross guide cam rollers (57) reach the ends of drive lever slot (45a) and driven lever slot (54a) closest to the center of rotation of pintle control shaft (53). Thus, setting controller rods (49) in and out of body (50a) equally produces different maximum flow to and from hydraulic pump (23) from and to lift cylinder (10) in a pumping cycle. The inequality of preset position between controller rods (49) by unequally adjusting nuts (48) produces unequal oscillatory movement in pintle control shaft (53) as drive lever (45) goes through a complete oscillation representing a complete upstroke and downstroke of the pumping unit piston (10a). Thus, the further controller rods (49) are withdrawn from body (50a), the greater the flow rate of hydraulic fluid to or from hydraulic pump (23).

Drive lever (45) is urged through a cyclical oscillation about drive lever pivot (46) by the controller drive crank (56), which rotates 360 degrees on each complete cycle of pumping unit piston and piston (10a) rod (12) (FIG. 1). A connecting rod (55) joins drive lever (54) and controller drive crank (56). Rotary movement of controller drive crank (56) is caused by two forces in each upstroke and each downstroke of piston rod (12) (FIG. 1). Viewing one complete 360-degree rotation of controller drive crank (56) as a complete upstroke and downstroke of piston rod (12), beginning with pintle shaft (53) in the neutral position (corresponding to the bottom of downstroke of piston rod (12)), the transition, or flow reversal movement of controller drive crank (56) is first controlled by the rotary motion of orbital hydraulic motor (42). Orbital motor (42) turns the motor pulley (42a), which is connected by v-belt or other suitable power transmission means (43) to a v-belt pulley (41) mounted on the controller drive crank axle (56a). Orbital motor (42) turns controller drive crank axle (56a) through approximately 90 degrees of rotation to the midpoint of piston rod (12) (FIG. 1) upstroke, thereby turning pintle shaft (53) to increase swashplate angle in hydraulic pump (23) at a constant rate in the first 90-degree phase to a maximum flow setting. After 90 degrees of rotation, the crank lever (60) mounted on the protrusion of crank axle (56a) through the opposite side of body (50a) drives crank axle (56a) and controller drive crank (56) by action of timing rod (51) through the second 90-degree phase of rotation which overrides the constant increasing flow rate caused by orbital hydraulic motor (42) in the first 90 degrees of rotation and decreases flow from maximum rate to zero.

The second 90 degrees of rotation of controller drive crank (56) is caused by the action of timing rod (51) having closed the gap, or longitudinal free play in the link (58) of timing rod (51). Timing rod (51) in this stage overrides the rotation of orbital motor (42). Link (58) joins two portions of timing rod (51) so that timing rod (51) only operatively links spiral timing shaft (11) with controller (50) in the second and fourth 90-degree quadrants of movement of crank axle (56a) and controller drive crank (56). Although the two phases of rotary movement of controller drive crank (56) caused by orbital motor (42) and timing rod (51) can be set to be of equal speed, it has been found with most applications a slower early phase of upstroke (corresponding to constant increasing flow from hydraulic pump 23) and faster latter stage of upstroke (corresponding to reducing the flow from such pump from maximum to zero flow) reduces stress on the sucker rods and provides them greater longevity. An important feature of the invention is the ability to decrease flow to zero through the hydraulic pump at a rate different from the increasing flow rate, thereby minimizing mechanical stress on the sucker rod string.

Referring now to FIG. 7, a schematic of a 360-degree pumping cycle according to the present invention is shown. The motion of piston rod (12) is shown corresponding to the time required to make such movement. Controller rods (49) have been set to the desired position and speed control (24) has been set to the desired speed or rate of movement for pintle shaft (53). In the lower left quadrant (I) of the graph, orbital motor (42) begins to cause movement of pintle control shaft (53) to start a constant increasing flow of hydraulic fluid to lift cylinder (10). Maximum movement of pintle control shaft (53) in the positive flow direction will be less than the full 22 degrees, so that such flow will be relatively slow, and produce a very smooth acceleration of piston rod (12) upward. In the upper left quadrant (II) of FIG. 7, movement of piston rod (12) sensed and indicated by spiral timing shaft (11) and transmitted by closure of the gap in timing rod (51) is shown. Such movement begins a diminishment of hydraulic flow to zero at a rate faster than the rate of increasing flow utilized in the lower left quadrant (I) (first 90 degrees) of the graph. As flow decreases to zero, and pintle control shaft (53) assumes the neutral position, the hydraulic pump swashplate (not shown) begins movement responsive to the constant speed set in orbital motor (42) to the reverse flow position. Pintle control shaft (53) is driven by orbital motor (42) in quadrant (III) of FIG. 7, since the gap in link (58) in timing rod (51) is now opening and prevents operative control by timing rod (51) of controller drive crank (56). Reverse flow is constant and smooth in acceleration through the midpoint of the downstroke of piston rod (12) (FIG. 1) representing full reverse flow. At such midstroke, the gap in link (58) is now fully open and timing rod (51) again operatively drives pintle control shaft (53) from full reverse flow to zero flow in the lower right quadrant (IV) of FIG. 7 at a rate different, and in this case, faster, than the increasing reverse flow of the upper right quadrant (III) of the graph. No operative force is exerted while the gap in link (58) is closing or opening. Only when the gap is fully opened or fully closed does timing rod (51) operatively override orbital motor (42). When the gap is opening and closing, pintle control shaft (53) is moved by orbital motor (42).

The time in the example above that is allocated to each of the quadrants I–IV is approximately 40%, 25%, 19% and 15%, respectively, of full cycle duration. It may also be seen that such example provides a "slower upstroke" and "faster downstroke", having allocated 66% of cycle time to upstroke, and 34% to downstroke.

Referring now to FIG. 6, the travel of piston rod (12) is plotted graphically against the angle of the swashplate (23a) in hydraulic pump (23). In the cycle designated as "A", a full stroke is illustrated with a slow upstroke and fast downstroke. In cycle "B", a half-stroke, or ½ maximum piston travel stroke, is illustrated, with a fast upstroke and slow downstroke. Cycle "A" could be of use in pumping a low viscosity fluid, whereas cycle "B" could be of use in pumping a high viscosity fluid.

Controller (50), after sensing the stage of stroke in lift cylinder (10), then relays the setting for the swashplate angle in hydrostatic pump (23). In the present embodiment, when the position or angle of the swashplate is perpendicular to power shaft (25), there is zero flow of hydraulic fluid between hydrostatic pump (23) and lift cylinder (10). Referring again to FIG. 6, a graphical presentation of piston rod (33) travel on the vertical axis versus flow of hydraulic fluid to and from hydrostatic pump (23) is shown. At the top of the upstroke of piston rod (33) (corresponding to apex of upstroke of the subsurface pump) and at the bottom of downstroke the swashplate of hydrostatic pump (23) has been moved by pintle control shaft (53) perpendicular to power shaft (25) and zero flow of hydraulic fluid is present. Depending upon the desired speed of upstroke and downstroke set by controller cylinder (24), the angle of the swashplate in hydrostatic pump (23) is urged away from the perpendicular relation to power shaft (25) so that at mid-upstroke or mid-downstroke of lift cylinder (10), the swashplate is at its maximum divergence (in negative and positive degrees, respectively) from perpendicularity with power shaft (25). At such position, flow is greatest between hydrostatic pump (23) and lift cylinder (10). As the piston in lift cylinder (10) approaches maximum up- or down-stroke position, the angle of swashplate stem (53) is rotated by pintle control shaft (53) to move the swashplate nearer perpendicularity to power shaft (25), thereby diminishing flow from hydraulic pump (23) and slowing the speed of piston rod (33).

Reversal of flow in hydrostatic pump (23) occurs at maximum upstroke and downstroke of the subsurface pump and the piston in lift cylinder (10). FIG. 6 shows that deviation in angle of swashplate stem (53) (and therefore the swashplate) in one direction (reflected by negative degrees on the graph) produces flow from the hydrostatic pump to lift cylinder (10) from hydrostatic pump (23). In the present embodiment, the swashplate may be deviated from perpendicularity to power shaft (25) by plus 22 degrees or minus 22 degrees. FIG. 4 shows a cycle "A" of 11 degrees negative swashplate angle for slow upstroke and 22 degrees positive angle for fast downstroke. This is the "fast up-slow down" cycle. Also note a fast-up and a slow-down half stroke is illustrated in cycle "B".

Referring again to FIG. 1, an auxiliary hydraulic pump (59) may be utilized to furnish controller (50) fine control power to controller cylinder (24) through the control valve (16) which controls flow in the control piping (18). Hydraulic fluid flows from fluid tank (40) through the control hydraulic supply line (61) to supply auxiliary hydraulic pump (59). Control valve (16) determines the speed of the pumping cycle by the degree of movement of controller rods (49). The length of stroke of the pumping unit is controlled by the setting of rod end bearing (27) in timing lever slot (31). The closer to the center of rotation of such setting, the longer the stroke of piston rod (12). Auxiliary hydraulic pump (59) also supplies hydraulic fluid to orbital motor (42) through control piping (18). Control piping (18) branches through the orbital motor control (63), a flow control valve, to furnish fluid to orbital motor (42). Hydraulic fluid which powers orbital motor (42) and controller cylinder (24) return to fluid tank (40) by the control hydraulic return line (62).

As hydraulic fluid flows from hydrostatic pump (23) to lift cylinder (10), the piston therein and piston rod (12) are forced upward on the power stroke. Flywheel (21) and power source (20) supply the energy in the power stroke to power hydrostatic pump (23). Some of the energy of flywheel (21) is expended in the power stroke, and the speed of flywheel (21) and power source (20) slow slightly. As the subsurface pump and piston rod (33) reach the apex of the stroke, controller (50) has moved the position of the swashplate in hydrostatic pump (23) from a maximum negative angle away from perpendicularity to a position approaching perpendicularity to power shaft (25).

At perpendicularity of swashplate and power shaft (25) (corresponding to zero degrees of swashplate stem oscillation) fluid flow in hydrostatic pump (23) is zero. As piston rod (33) passes the apex of stroke, the weight of the sucker rods now cause the piston in lift cylinder (10) to descend and force hydraulic fluid from lift cylinder (10) through hydraulic power line (19) and through hydrostatic pump (23). The swashplate (not shown) has moved to a slightly positive angle and that angle continues to increase until the midpoint of downstroke. The force of hydraulic fluid through hydrostatic pump (23) causes the power source and the inertial assist to speed up slightly as a result of the addition of kinetic energy from the falling sucker rods to the speed of flywheel (21) and other turning masses in the power train. Thus, kinetic energy from the downstroke of the subsurface pump has been gathered and saved in flywheel (21) for utilization, again after reversing the fluid flow in hydrostatic pump (23), to aid in powering the upstroke of the subsurface pump.

One example of sizing of such a flywheel and its power source would be a 36" diameter, 8" thick 2400-pound steel disc flywheel turned at 2400 r.p.m. with a power source of approximately 30 horsepower. When lifting a 8000-foot string of sucker rods and fluid through a 12-foot stroke, 176,000 foot pounds of power would be expended. A substantial portion of that power will be recaptured during downstroke when flow is forced by the falling rods through hydrostatic pump (23). During upstroke, the speed of the flywheel will diminish to approximately 2300 r.p.m. Approximately 156,000 foot pounds of power would come from the flywheel and approximately 20,000 foot pounds would come from the prime mover. During downstroke, approximately 138,000 foot pounds will be derived from the falling sucker rod mass and, together with approximately 20,000 foot pounds of power from the prime mover, the flywheel will gather sufficient kinetic energy to again turn at 2400 r.p.m. When run in a prototype unit, energy savings were calculated to be approximately 29% compared with such a unit not utilizing a flywheel. This savings was realized because of the even loading on the prime power source.

Thus it can be seen that a novel and efficient controller for hydraulically actuated subsurface pumping has been shown. Application of slowest linear movement of the sucker rod string during the period of greatest tension on the string reduces stress failures. Furthermore, energy can be obtained during the downstroke of the pump and utilized in the power for the upstroke.

What is claimed is:

1. A mechanical controller for down-hole hydraulic pumping units, comprising:

means for sensing a position of a pumping unit piston, said piston being coupled by sucker rods to a subsurface pump;

means mechanically linked to said sensing means for transmitting the said position of said pumping unit piston to a reversible and variable flow hydraulic pump;

means for controlling transition from downstroke to upstroke and upstroke to downstroke of said pumping unit piston so as to produce minimum acceleration differences of a mass supported by said pumping unit piston at the transition phases in the upstroke and downstroke portion of a pumping cycle and for variably increasing flow from zero to full preset flow through said hydraulic pump in a first portion of each of the upstroke and downstroke phases of said pumping cycle; and means for overriding said controlling and increasing means to decrease flow through said hydraulic pump from full flow to zero at a rate independent of the rate of increase from zero to full flow.

2. A mechanical controller as claimed in claim 1, wherein:

said transition controlling means comprises a preset and constant speed rotary drive source operatively establishing flow rate and direction in said hydraulic pump only during flow reversal and flow increase of said hydraulic pump.

3. A mechanical controller as claimed in claim 1, wherein:

said overriding means comprises a timing rod operatively linking said sensing means and said hydraulic pump only during the decreasing flow phase of each pumping unit piston upstroke and pumping unit piston downstroke.

4. A mechanical controller as claimed in claim 1, including:

means to vary the volume of hydraulic fluid pumped to cylinder supporting said pumping unit piston during a full upstroke or full downstroke of said pumping unit piston.

5. A mechanical controller for a hydraulic pumping unit, comprising:

a pumping unit piston supporting sucker rods, which sucker rods are mechanically coupled to a subsurface pump;

a hydraulic cylinder supporting said pumping unit piston;

a base which supports said hydraulic cylinder;

means for indicating a position of said pumping unit piston relative to said base fixed with respect to said base;

a mechanical link coupling said indicating means to said controller;

a reversible variable flow hydraulic pump means fluidly connected to said hydraulic cylinder for furnishing fluid to said hydraulic cylinder to power said pumping unit piston on upstroke and to derive power from said pumping unit piston on downstroke;

means for reversing flow through said hydraulic pump when said pumping unit piston is located at the uppermost portion of upstroke and the lowermost portion of downstroke and increasing flow through said hydraulic pump during the first portion of upstroke and the first portion of downstroke; and, means for overriding said flow reversing and increasing means to reduce full preset flow through said hydraulic pump to zero as said pumping unit piston approaches maximum upstroke and downstroke positions.

6. The controller claimed in claim 5, including:

means for varying upstroke and downstroke speed of said pumping unit piston with respect to each other.

7. The controller as claimed in claim 5, including:

means for varying the length of the full travel stroke of said pumping unit piston.

8. The controller as claimed in claim 5, wherein said reversing and increasing means includes:

a low pressure hydraulic motor furnishing rotary motion at a predetermined speed; and means for utilizing the rotary motion of said low pressure hydraulic motor only to reverse hydraulic fluid flow through said hydraulic pump and to increase the angle of the swashplate of said hydraulic pump, thereby increasing fluid flow through said hydraulic pump.

9. The controller as claimed in claim 5, wherein said overriding means includes:

a timing rod having limited longitudinal free play linkage coupling said indicating means to said means for utilizing rotary motion.

10. In a method for effecting a cycle of full upstroke and full downstroke for a hydraulically actuated subsurface pump, the combination of steps comprising:

pumping hydraulic fluid to a cylinder supporting a pumping unit piston operating said subsurface pump at a constant increasing rate until a preset maximum flow rate is reached at mid-upstroke of the cycle;

thereafter decreasing hydraulic fluid flow to said cylinder to zero at a rate faster than said constant increasing rate until flow ceases at full upstroke of the cycle;

reversing the flow of hydraulic fluid to said cylinder and increasing the reversed flow at a constant rate until maximum reverse flow rate is reached at mid-downstroke of the cycle; and, reducing the reversed flow rate to zero at a rate faster than said constant reversed rate.

11. In a method for hydraulically operating a pumping unit piston operatively connected to a subsurface pump, the steps comprising:

utilizing a reversible flow hydraulic pump to lift and lower a pumping unit piston by filling and emptying a cylinder supporting said pumping unit piston;

pumping hydraulic fluid to said cylinder at a predetermined increasing rate during a first portion of pumping unit piston upstroke and at a different decreasing rate during the latter portion of pumping unit piston upstroke;

reversing flow in said hydraulic pump at the beginning of downstroke of said pumping unit piston;

causing a falling mass attached to said pumping unit piston to force fluid from said cylinder to said hydraulic pump at a predetermined increasing rate during a first portion of downstroke of said pumping unit piston and at a different decreasing rate during the latter portion of said downstroke.

12. The method as claimed in claim 11, including the step of:

gathering the energy generated by said falling mass in a flywheel connected to the power train of said hydraulic pump.

* * * * *